United States Patent [19]

Biasini et al.

[11] Patent Number: 4,719,835

[45] Date of Patent: Jan. 19, 1988

[54] VIOLIN CHINREST INSERT

[75] Inventors: Americole R. Biasini, Bellingham, Wash.; Paul C. Anastasio, Nashville, Tenn.

[73] Assignee: RICO Products, Sun Valley, Calif.

[21] Appl. No.: 922,737

[22] Filed: Oct. 23, 1986

[51] Int. Cl.[4] ..... G10D 3/18

[52] U.S. Cl. ..... 84/279; 84/452 P

[58] Field of Search ..... 84/278–280, 84/327, 385 P, 452 P, 453

[56] References Cited

U.S. PATENT DOCUMENTS

| | | | |
|---|---|---|---|
| 1,023,234 | 4/1912 | Williams | 84/279 |
| 3,247,749 | 4/1966 | Gullotta | 84/385 P |
| 3,631,754 | 1/1972 | Kun | 84/280 |
| 3,979,993 | 9/1976 | Proctor | 84/327 |
| 4,453,444 | 6/1984 | Valentino | 84/385 P |
| 4,534,259 | 8/1985 | Wolf | 84/279 |

*Primary Examiner*—Lawrence R. Franklin

*Attorney, Agent, or Firm*—Blakely, Sokoloff, Taylor, Zafman

[57] ABSTRACT

An insert for a chinrest for a violin or viola is disclosed for providing the chinrest with a contoured shape to conform to the shape of a performer's chin and jaw. The insert comprises a volume of malleable material capable of retaining an imprint of the performer's chin. The insert is secured to the chinrest and covered with a soft absorbent material. The method of utilizing the insert to modify existing chinrests is also disclosed.

16 Claims, 10 Drawing Figures

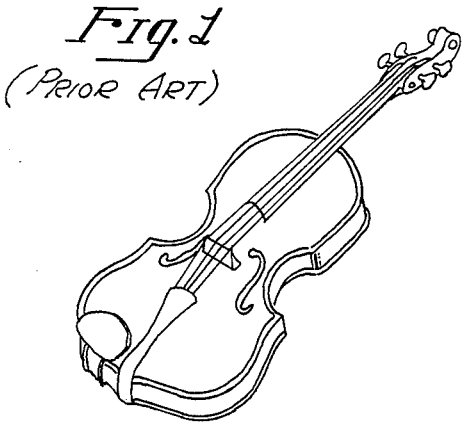
Fig. 1
(Prior Art)
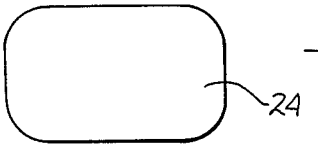
Fig. 9
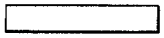
Fig. 10
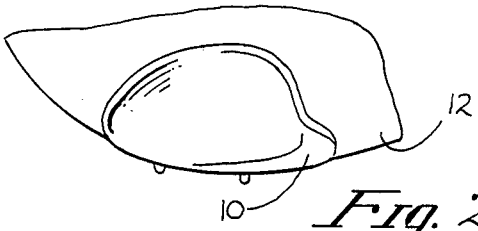
Fig. 2
(Prior Art)
Fig. 3
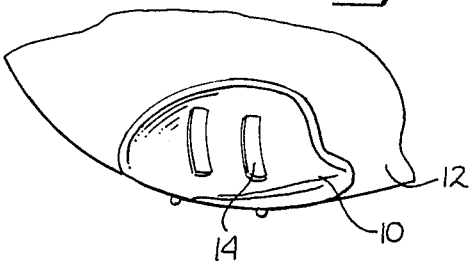
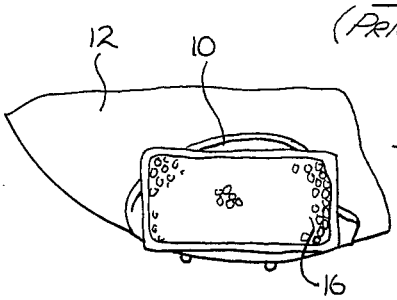
Fig. 4
Fig. 5
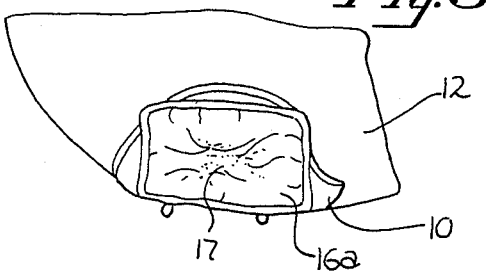
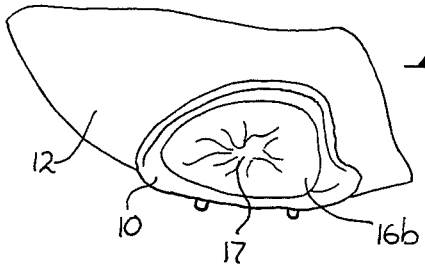
Fig. 6
8
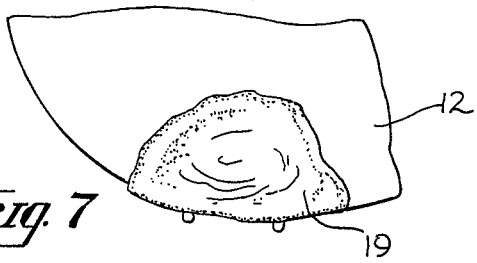
Fig. 7
8
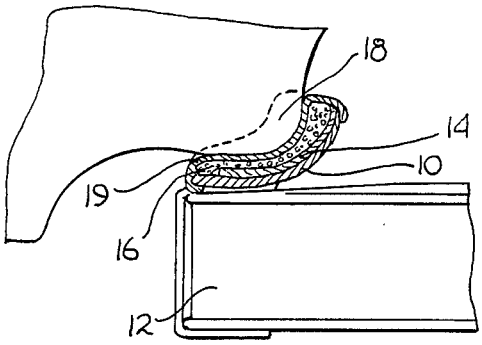
Fig. 8

VIOLIN CHINREST INSERT

FIELD OF THE INVENTION

This invention relates generally to a chinrest for a violin or the like, and more specifically, to a device and method for providing a violinist and/or violist with a means of adjusting any conventional chinrest to the idiosyncratic contours of a performer's chin and jaw, rendering greater comfort to the performer and control over the instrument.

BACKGROUND OF THE INVENTION

Violins and violas are held by a performer with one hand positioned along the neck of the instrument and the base of the instrument is held in place between the chin and shoulder of the player. In use, the player places his chin on a chinrest affixed to the base of the violin pressing the chinrest downward so that the instrument is pressed against the performer's shoulder. It is typically necessary for the performer to be able to manipulate the position of the instrument by applying appropriate pressure against the chinrest with his chin. Moreover, it is often necessary for the player to position his chin on the chinrest for extensive periods of time during both practice and performance, so that optimum comfort of the chinrest becomes important.

A conventional chinrest is typically formed of wood or plastic and is preferably carved or molded into a shape having a concave upper surface of sufficient size to accomodate varying sizes and contours of chins and jaws of performers. However, the prior art concave upper surface does not conform to the idiosyncratic contours of most chins and jaws. For example, some chins are jutting having sharp lines while others are rounder. Further, some chins are bonier than others which are covered with more fleshy tissue which generally provides a padding for the performer's chin. Thus, for obvious reasons, the prior art chinrest may be a source of considerable discomfort to the performer. In fact, many beginning violinists do not progress beyond the early stages of violin instruction because of the discomfort suffered in their chin and jaw as a result of the uncomfortable chinrest.

Furthermore, with respect to more skilled and experienced performers, the chin is used to control the angle and position of the instrument. For that reason, a properly shaped chinrest is important in the control of the instrument, and it is widely known that faulty left wrist and finger position may result if proper control of the instrument cannot be obtained.

The conventional solution to the problem of an uncomfortable and misfitting chinrest is to place padded overlays on the chinrest. Unfortunately, this does not work satisfactorily for most students of the violin or viola because the contour of the chinrest is not form-fitting, so that the contour of the overlay is similarly unsatisfactory. Thus, the industry is still awaiting a viable solution to the above-described problems. One solution to the problem is disclosed in U.S. Pat. No. 1,760,593, which discloses a chinrest formed from a mold taken directly from the jawbone of a human placed in playing position. However, there is no teaching that the chinrests may be customized to the shape of the jawbone for each individual performer.

In the U.S. Pat. No. 4,534,259, a chinrest design was disclosed having support brackets which allow the chinrest to pivot to a most comfortable position in accordance with the movements of the chin of the performer.

None of the prior art, however, discloses a chinrest and a method of making the same in which the shape of the chinrest is customized to the shape of an individual performer's jaws. The benefits of the invented device and method are described below.

SUMMARY OF THE INVENTION

The present invention comprises a device and method for modifying existing violin and viola chinrests to provide a performer with additional comfort in the form of a chinrest contoured to the shape and size of the performer's chin and jaw bone. The present invention comprises an insert for a violin and/or viola chinrest formed of malleable material which may be cured or hardened to retain its desired shape. Plastics, resins, clays, thermo-plastics, epoxies and other polymerizable material may be used. In the preferred embodiment, the insert is a relatively flat, rectangular piece of plastic. In another embodiment, one or more packages of plastic material which are meltable at reasonable temperatures are used. The material is softened sufficiently so that an imprint of a performer's chin may be made, and then disposed on the chinrest in position. The invention is also provided with a means for attaching the insert to an existing chinrest so that the attaching means can be applied to a chinrest and an imprint of the performer's chin made in the insert in its actual position on the instrument. The insert is then allowed to hardened, is preferably trimmed to an aesthetically pleasing shape and is permanantly affixed to the chinrest. The invented insert may then be covered with a soft material such as cloth or ultrasuede to provide additional comfort to a user.

It is an object of the invention to provide an insert for a chinrest which enables a performer to comfortably hold a violin.

It is another object of this invention to provide a chinrest which is custom-fitted to the chin and jaw bone of an individual performer.

It is yet another object of this invention to provide an insert for adapting existing violins and violas to provide improved comfort to performer's chin and jaw.

It is yet another object of this invention to provide improved control of a violin or a viola to correct faulty left wrist and finger position.

This and other objects of the present invention will become apparent from the drawings and detailed disclosure provided herein.

BRIEF DESCRIPTION OF THE DRAWINGS

FIG. 1 illustrates a perspective view of a violin with a standard chinrest (prior art).

FIG. 2 illustrates a top enlarged view of the chinrest shown in FIG. 1 (prior art).

FIG. 3 illustrates a top view of the chinrest provided with attachment means for attaching the invented insert to the chinrest.

FIG. 4 illustrates a top view of the invented insert attached to the chinrest.

FIG. 5 illustrates a top view of the present invention of the invented insert with a chin impression disposed therein.

FIG. 6 illustrates a top view of the invented insert with the edges trimmed.

FIG. 7 illustrates the insert covered with a covering material.

FIG. 8 illustrates a cross-sectional view of the insert taken through lines 8—8 of FIG. 7 and showing positioning of a performer's chin thereon.

FIG. 9 illustrates a superior plan view of the preferred embodiment chinrest insert.

FIG. 10 illustrates a cross-sectional view taken through lines 10—10 of FIG. 9.

DETAILED DESCRIPTION

The present invention provides a chinrest 10 for a violin or viola 12 as shown in FIG. 1, with a contoured shape that is form-fitting to a performer's chin and jaw. FIG. 2 is an enlarged view of a standard chinrest. As is shown in FIG. 2, the standard chinrest comprises a bowl or cup-shaped device which is generally made out of wood or plastic and which is fastened to the edge of the violin or viola 12. Of course, it will be appreciated by a person of ordinary skill in the art that the present device is easily adaptable to a chinrest of any shape and size.

As shown in FIG. 3 the chinrest is provided with an attachment means 14 which is used to attach the chinrest insert to the chinrest 10. In the preferred embodiment the attachment means 14 comprises strips of double-sided tape capable of securing the chinrest 10 to the insert. It is preferable to use an attachment means which, if necessary, will allow the insert to be reversibly removed from the chinrest if, for example, it is necessary to re-form the shape of the insert if the proper shape is not obtained or to replace the insert with one shaped for a different performer if the instrument is sold or traded. However, the attachment means should be sufficiently secure so that extended hours of playing the violin or viola with the typical amounts of pressure applied to the chinrest will not cause the insert to dislodge from the chinrest. As an alternative attachment means, it is anticipated that any type of adhesive materials such as glue, paste, plastic resin, and the like, and any mechanical attachment means such as screws, brackets, ties, or any combination of any of the foregoing, may be used without departing from the scope of the present invention.

The insert is preferably attached to the chinrest after it is softened or made malleable, or while it is in a soft and/or malleable condition prior to the hardening thereof. In the preferred embodiment a sheet of material as shown in FIGS. 9 and 10 as the insert. The insert 24 is generally rectangularly shaped and is of sufficient thickness to form a contour of a performer's chin and jaw. In the another embodiment the insert is comprised of a temperature-resistant plastic bag containing a plastic resin which is capable of melting to a soft, relatively viscous material at temperatures around or below 100° C. Using any such material, the chinrest can be softened by placing it in boiling water as described in more detail below. In the particularly preferred embodiment, a material is used such as a high vinyl acetate resin or ELVAX 40-W (Du Pont Company, Wilmington, Del.) which can be provided in pellet form or solid form. Either form may be re-melted to a softened state a number of times in the event that it is necessary to re-form the insert. The solid form appears to allow deeper impressions to be formed therein, tends to eliminate air pockets which result when the pellet form is melted and provides a visual impression to the user of the form of the insert will take after attachment to the chinrest. Furthermore, the solid form is quicker and easier to process because it takes less time to melt than the pellet form.

It is preferable that the inverted insert be provided in at least two sizes, namely a small size approximately 1.5×2.5 inches for smaller violin and viola containing approximately 3 teaspoons of plastic material, and a large size of approximately 2.25×3.5 inches for larger violins and violas containing approximately 7 teaspoons of material.

A packet containing the meltable plastic material or a solid sheet of material comprising the insert is placed in boiling water, or in a stream of hot air such as from a hair dryer for 10 minutes or until the insert has softened. The insert is then dried with a cloth (if wet) and placed on the chinrest, in position, on the strips of adhesive tape 14 or held in place by other attachment means. The performer then places the instrument in a playing position making an impression of his chin and jaw in the insert, and holds this position for at least five seconds. After a few minutes, when the melted plastic begins to turn solid, the packet can be trimmed to the shape of the chinrest with a pair of scissors, knife, or the like. The plastic is allowed to harden completely for approximately fifteen minutes. Thereafter, the formed insert is removed from the chinrest, and in the case of the plastic pellets, the plastic bag is removed from the insert and the insert is placed on the chinrest in position.

FIG. 4 shows the insert 16 prior to making an impression 17 therein and FIG. 5 shows the insert **16*a* after an impression 17 is made therein. As shown in FIG. 6, the edges of the chinrest 16*b* are trimmed so that the chinrest fits comfortably and aesthetically within the chinrest 10. As shown in FIG. 7, the chinrest may then be covered with a soft cover 19 such as ultrasuede or cloth to provide a smooth and somewhat adsorbent surface for the performer's chin. As shown in FIG. 8, which is a side view of the present invention, a performer's chin fits within the contours of the device comfortably, evenly and smoothly without any creases, lumps or the like. The performer's chin 18 is disposed on the cover 19 which, in turn, is disposed on the insert 16, which is attached to the chinrest 10 by attachment means 14**. The result is a chinrest with a contour custom-made for the performer's chin and jaw, affording comfort, control and correct wrist and finger position to the performer.

In the preferred embodiment, the cover 19 is preformed to the approximate shape and size of the chinrest with the insert disposed thereon and an indentation provided therein. The cover 19 also preferably has an elastic material disposed therearound to hold the cover on the chinrest.

It will be obvious to a person of ordinary skill in the art that a number of changes and substitutions can be made to the present invention without departing from the spirit and scope thereof. The present invention is not limited by th specific embodiments disclosed and described herein, but rather by the claims appended hereto and all equivalents thereof.

We claim:

1. An insert for an instrument chinrest comprising:

a volume of malleable material for obtaining an imprint of a chin of a performer of the instrument, said material being hardened after the chin imprint is made therein; and attachment means for attaching said material to said instrument chinrest.

2. The insert of claim 1 wherein said material comprises a plastic which softens when subject to elevated temperature and hardens when cooled to ambient temperature.

3. The insert of claim 2 wherein said material comprise high vinyl acetate resin.

4. The insert of claim 2 wherein said volume of malleable material comprises pellets of meltable plastic disposed in a flexible container.

5. The insert of claim 2 wherein said volume of malleable material comprises a solid sheet of meltable plastic.

6. The insert of claim 2 wherein said volume of malleable material is approximately the size of a violin or viola chinrest.

7. The insert of claim 1 wherein said attachment means comprises double-sided adhesive tape.

8. The insert of any one of claims 1–7 further comprising a soft, absorbent cover means for covering said insert and said chinrest.

9. An insert for providing a violin or viola chinrest with a contoured shape to conform to the chin of a performer comprising:

a solid sheet of malleable plastic which is softened when heated so that an imprint of a performer's chin can be made therein, said material being hardened upon cooling for retaining therein said chin imprint;

attachment means attaching said plastic material to said chinrest, said attachment means comprising double-sided adhesive tape; and a soft, absorbent cover for covering said insert when disposed on said chinrest.

10. A method of modifying a chinrest of an instrument to conform to the contour of the chin of a performer comprising the steps of:

providing an violin or viola having a chinrest;

providing a volume of malleable material comprising an insert, said material being hardenable to retain an imprint of said performer's chin;

positioning said insert on said chinrest;

positioning said instrument in playing position with said performer's chin disposed on said insert;

forming an imprint of said performer's chin in said insert;

allowing said insert to harden to retain said imprint therein; and securing said insert to said chinrest.

11. The method of claim 10 wherein said attachment means comprises double-sided adhesive tape.

12. The method of claim 10 wherein said insert is rendered malleable by elevating its temperature, and said insert is hardened by cooling to ambient temperatures.

13. The method of claim 10 further comprising the step of covering said insert and chinrest with a soft absorbent material after said insert is secured to said chinrest.

14. The method of claim 10 wherein said volume of malleable material comprises high vinyl acetate resin.

15. The method of claims 10 or 14 wherein said volume of malleable material comprises a solid sheet.

16. The method of claim 10 wherein said malleable material is approximately the size of a violin or viola chinrest.

* * * * *